US006161868A

United States Patent [19]

Verhoff et al.

[11] Patent Number: 6,161,868

[45] Date of Patent: Dec. 19, 2000

[54] SUPPORT FOR BOOK PAGES AND BINDINGS

[76] Inventors: Jonathan M. Verhoff, 13926 State Rte. 694, Ottawa, Ohio 45875; Sajeev Menon, 3220 Whispering Pl., #199, Memphis, Tenn. 38115; Siowmene Litingtung, 728 Young Graduate House, Lafayette, Ind. 47904

[21] Appl. No.: 09/239,580

[22] Filed: Jan. 29, 1999

[51] Int. Cl.[7] ..... B42D 9/00

[52] U.S. Cl. ..... 281/42

[58] Field of Search ..... 281/15.1, 20, 21.1, 281/28, 51, 42, 45, 33; 116/239

[56] References Cited

U.S. PATENT DOCUMENTS

| | | | |
|---|---|---|---|
| 763,554 | 6/1904 | Greene | 281/20 X |
| 4,524,991 | 6/1985 | Thomas | 281/20 |
| 4,687,226 | 8/1987 | Rose, Jr. | 281/20 X |
| 5,947,521 | 9/1999 | Stucki | 281/20 |

FOREIGN PATENT DOCUMENTS

| | | | |
|---|---|---|---|
| 692 472 | 6/1940 | Germany | 281/20 |

*Primary Examiner*—Willmon Fridie, Jr.
*Attorney, Agent, or Firm*—Miller Nash LLP

[57] ABSTRACT

The invention is a support for the binding and pages of a book stored on a bookshelf. A substantially flat base provides subjacent support when it is inserted in the space between the edges of the pages and the surface of the bookshelf. The support is attached to the book by adhesive strip or by a bookmark. The width of the support's base is adjustable to fit varying thicknesses of books.

2 Claims, 7 Drawing Sheets

SUPPORT FOR BOOK PAGES AND BINDINGS

FIELD OF THE INVENTION

This invention relates to book supports. More particularly, it relates to a substantially flat base that can be inserted in the space under a book's pages and between its hardback covers, for providing support to the book binding and its pages.

BACKGROUND OF THE INVENTION

Hardback books are valuable. They are expensive to purchase. They also are valuable because they are handy reference materials that can be easily pulled off a shelf. The sentimental value of some books, such as family Bibles and high school yearbooks, is immeasurable.

Despite their value, books are not made to be very durable. Their hardback covers, pages, and bindings are easily worn down and damaged during use and shelf storage. Book covers are commonly used to protect the hardback covers of books from wear and tear, but these book covers do not provide any protective support for the bindings (spine) and pages.

Damage to a book's spine during shelf storage can be severe, especially to books that have a significant number of pages (i.e., "thick" books). The problem is illustrated in FIGS. 1 and 2. FIG. 1 shows the characteristic "sag" that hardback book pages exhibit during shelf storage. This "sag" is the vertical deformation of pages of a book while it rests on a shelf. The deformation is due to the weight of the pages when the pages cannot be supported by the book binding, although in some instances, the sag is caused by the improper manufacturing of the book. Eventually, binding failure, shown in FIG. 2, will occur. Because the binding cannot support the pages, the glue or fabric that holds the pages to the binding will fail, causing blocks of pages to separate from the binding. Repairing this damage can be laborious and expensive.

At present, when books are stored vertically on a shelf, pressure needs to be applied to the front and back covers of the books in order to prevent sag and book binding damage. The pressure allows the pages to support each other's weight through friction between the pages. However, adequate pressure must come from bookends or other books on the shelf. When insufficient pressure is applied or when a book is removed from the shelf, the ideal storage condition for that book and the other books remaining on the shelf is destroyed.

Accordingly, there exists a need to provide a support for the binding and pages of a book so as to prevent sag and binding damage. Further, the support must be inexpensive, easy to manufacture, and convenient to use on varying thicknesses of books. There is no known device that accomplishes these objectives. The inventors' book support invention solves the problems discussed above and is summarized below.

SUMMARY OF THE INVENTION

The invention is a support for the binding and pages of a book that is stored on a bookshelf. The support is a substantially flat base that can be inserted in the space between the edges of the pages of the book and the surface of the bookshelf.

The base has an upper surface that rests under and against the pages and a lower surface that rests over and against the surface of the bookshelf. In this fashion, subjacent support is provided to the pages.

The support is affixed to the book's hardback cover by an adhesive strip attached to the base. In a second and alternative embodiment, the support is held in place by a bookmark attached to the base.

The width of the base is adjustable to fit books having different thicknesses. In a third embodiment, slidable sections are attached to the base. In a fourth embodiment, the base consists of two, slidable, mating sections. Two sliding triangle-shaped sections comprise the fifth embodiment. The base in the sixth embodiment is a compliant material that can be compressed to fit between the hardback covers of a book. The seventh embodiment of the support has an adjustable base having a scissor mechanism.

The base can be made out of either a paper or plastic material. For a base made of paper, wood pulp is pressed into sheets and cut into the appropriate shapes and sizes. Afterwards, the base is coated with a laminate. For supports made of plastic, thermoplastics or thermosetting materials are used, along with various fillers and coloring material. Processes to create the plastic bases include injection molding, reaction injection molding, compression molding, casting, and extrusion.

How the invention works and the specific details of these embodiments are discussed in the following paragraphs.

BRIEF DESCRIPTION OF THE DRAWINGS

In the drawings, unless otherwise indicated, like reference numerals and letters refer to the like parts throughout the various view, and wherein.

BEST MODE FOR CARRYING OUT THE INVENTION

Figure 1:
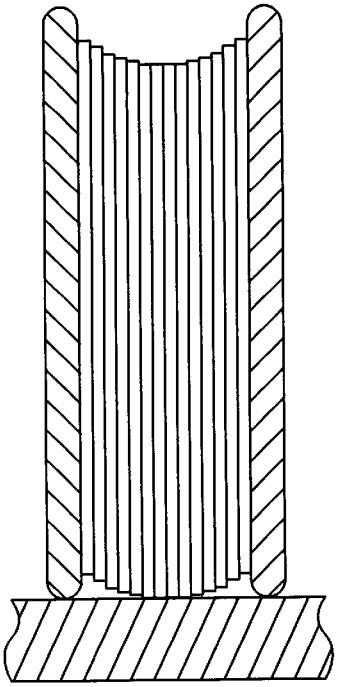
FIG. 1 shows the "sag" of a book that is stored on a shelf.
Figure 2:
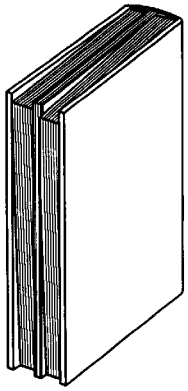
FIG. 2 shows a book damaged as a result of the sag shown in FIG. 1.
Figure 3:
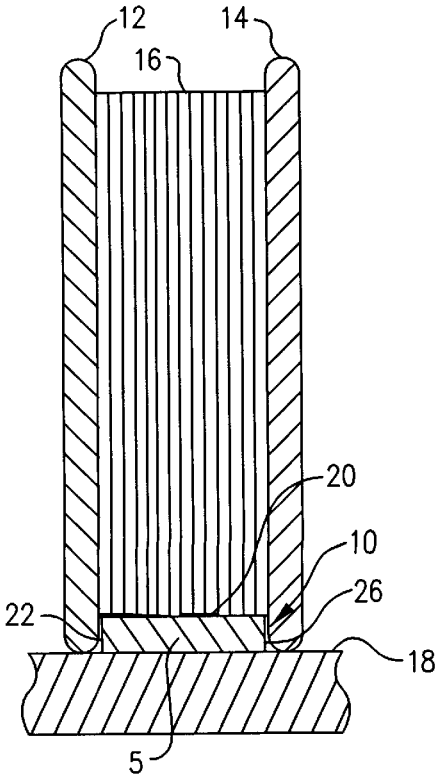
FIG. 3 shows the book support invention fitted into a book stored on a shelf.

Referring first to FIG. 3, shown generally at 10 is the inventors' book support. Support 10 is a substantially flat base 5 insertable between the hardback covers 12 and 14 of a book. As can be seen by viewing FIG. 3 in conjunction with FIG. 1, the support 10 prevents sag by supporting the pages 16 of a book above and against the bookshelf surface 18.

Figure 4:
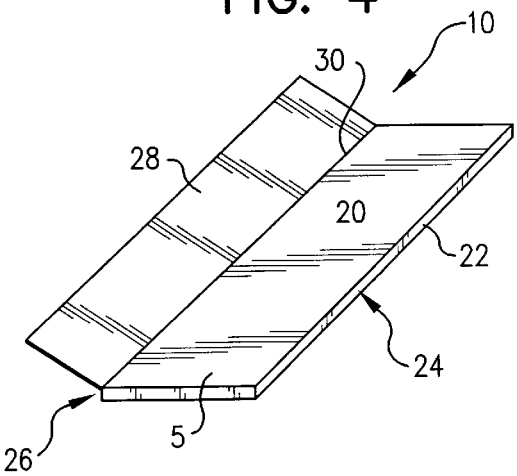
FIG. 4 is a three-dimensional view of the first embodiment of the book support invention.

FIG. 4 shows the first embodiment of the support 10. Ideally, the support 10 consists of a rectangular base 5 that will match the rectangular space between the hardback covers of a book. It is to be appreciated, however, that the base 5 can take on varying forms, including circular, diamond-shaped, elliptical, and trapesoidal outlines. What is important is that the base 5 has an upper surface 20 that rest under the book pages 16, and a lower surface 24 that rests over the bookshelf surface 18. The edges 22 and 26 of the base 5 face the inside surface of the hardback covers 12 and 14 respectively when the support is in place (See FIG. 3). To provide maximum spinal support, the thickness of base 5 is roughly equivalent to the thickness of the hardback covers 12 and 14. It is essential that the width of base 5 matches the width of the space between the hardback covers 12 and 14. It is not necessary, however, for the length of base 5 to match the length of the space between hardback covers 12 and 14.

Figure 5:
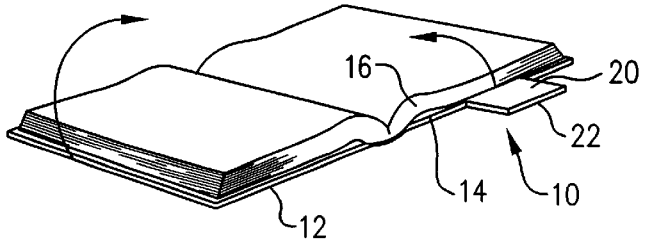
FIG. 5 shows the first embodiment fitted into an open book.
Figure 6:
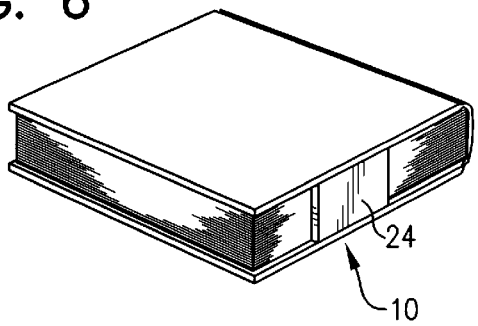
FIG. 6 is a view like FIG. 5 but shows the first embodiment fitted into a closed book.
Figure 7:
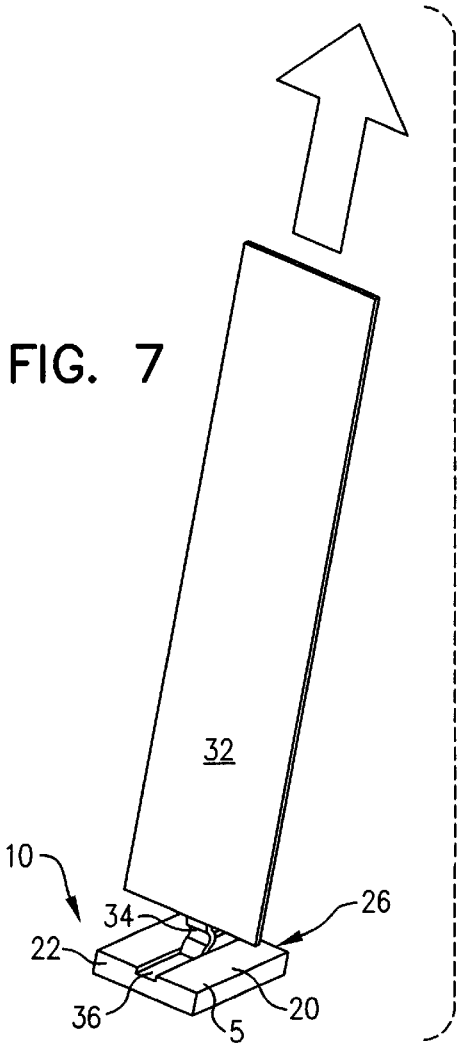
FIG. 7 shows the second embodiment of the invention.

Adhesive strip 28 is attached to the base 5. Strip 28 can be made out of polyethylene, polyurethane, paper, cotton, nylon fabric or any other suitably durable and flexible material. Strip 28 is attachable to base 5 by any appropriate means familiar to those skilled in the art, including gluing, fusing, or stapling. What is important is that strip 28 can bend like a hinge at edge 30, where it attaches to base 5. As seen in FIGS. 5 and 6, if adhesive is applied to the underside of strip 28 and then strip 28 is adhered to the inner surface of hardback cover 14, the base 5 is attached semi-permanently to the book. The base 5 is free to swing/flip to a "down" position when the book is in use (See FIG. 5) and to a "close" position when the book is ready for shelving (See FIG. 6).

FIGS. 7–11 illustrate a second embodiment of the support 10. In the first embodiment, adhesive strip 28 was required to hold the support 10 in place. In the second embodiment, a bookmark 32 is combined with base 5 to hold support 10 in place between the hardback covers of a book. Bookmark 32 can be made of cotton or nylon, polyethylene, polyurethane, heavy paper, or any other suitably durable and flexible material which would be known by those familiar with the art. Bookmark 32 is attachable to base 5 by a clip 34. Clip 34 can be made of aluminum foil, wire, filled polymer or any other material that is malleable and retains it shape (i.e., can be easily shaped). Clip 34 is attachable to bookmark 32 and to base 5 by simply gluing it to these components or by using small wire hinges. The appropriate means of attachment would be known by those skilled in the art.

Channel 36 is particularly useful when the bookmark is not placed in between the middle pages of the book. For example, if the bookmark is placed near the last remaining pages of a book, the clip 34 can flex flat into the channel 36, thereby keeping the base 5 snug between the hardback covers of the book and flush against the edges of the pages 16, even though the bookmark 32 is not centered in the book.

Figure 8:
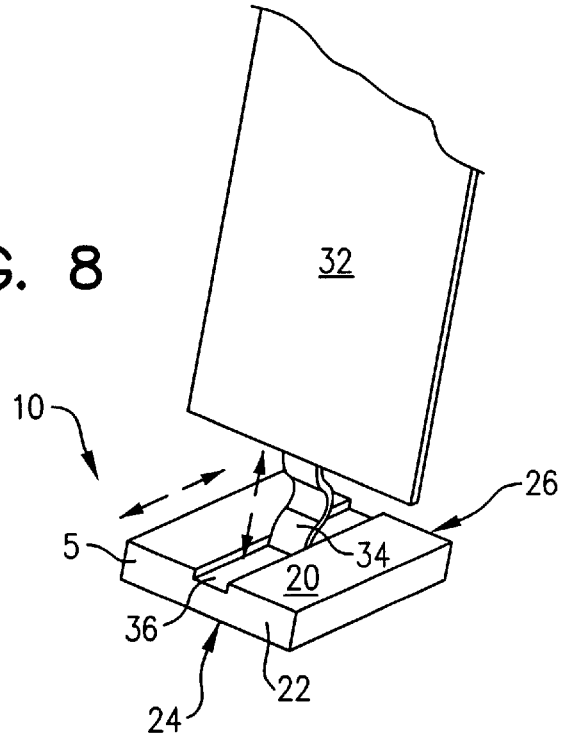
FIG. 8 is a partial and enlarged view of the embodiment shown in FIG. 7.
Figure 9:
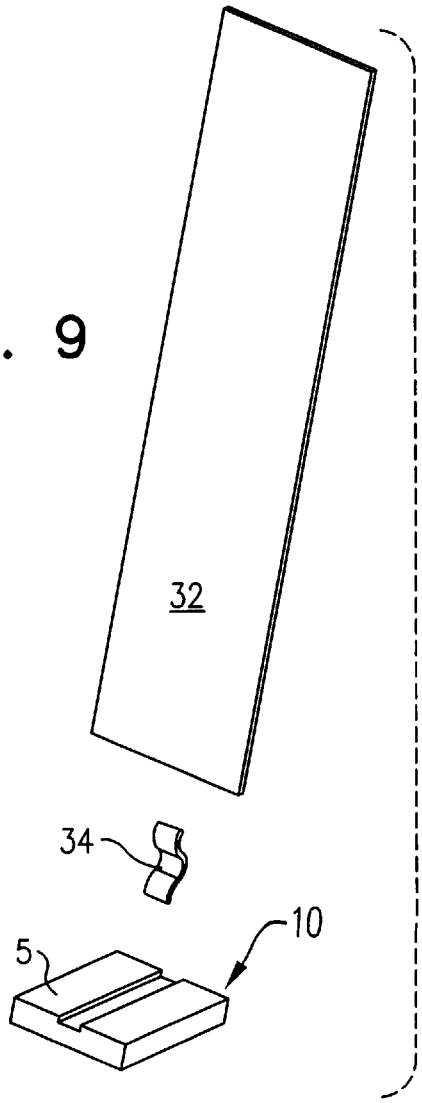
FIG. 9 is an exploded view of the embodiment shown in FIGS. 7–8.

FIGS. 8 and 9 show the second embodiment in greater detail. Clip 34 can flex vertically or horizontally so that the bookmark 32 can fit snugly between the pages of a book, without the clip 34 getting in the way. Ideally, the clip 34 will fit into the grooved channel 36 in the base 5 so that the flexing clip 34 will not jam against the book pages or otherwise hinder the even support that base 5 provides.

Figure 10:
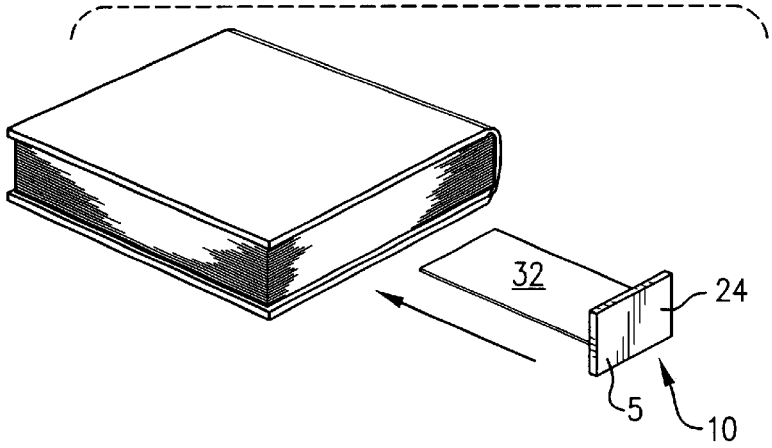
FIG. 10 shows how the second embodiment is positioned.
Figure 11:
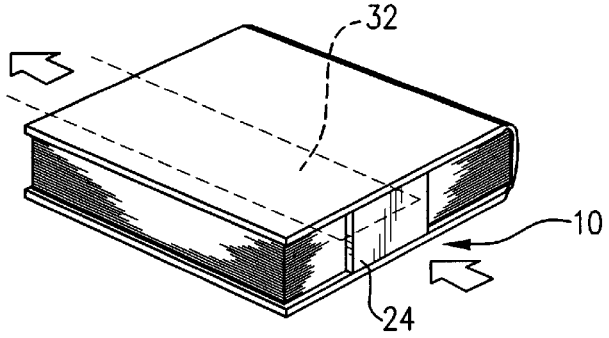
FIG. 11 is a view like FIG. 10 but shows the second embodiment fitted into a book.

FIGS. 10 and 11 show how the base 5 with the bookmark 32 is oriented and inserted into a book. The second embodiment is preferable to book owners who do not want the support 10 permanently attached to their books, as in the first embodiment.

Figure 12:
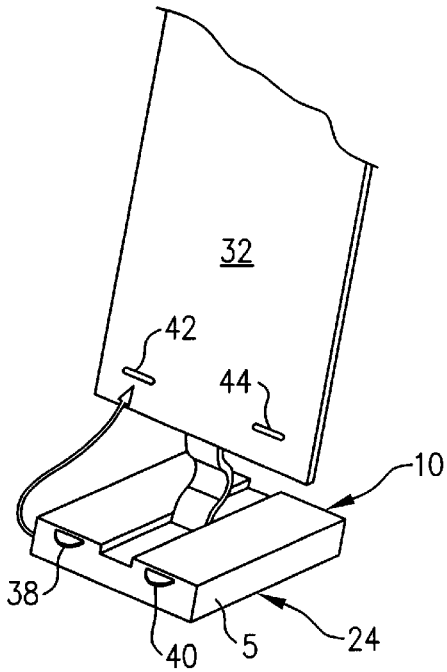
FIG. 12 shows a means for clipping the second embodiment of the invention.
Figure 13:
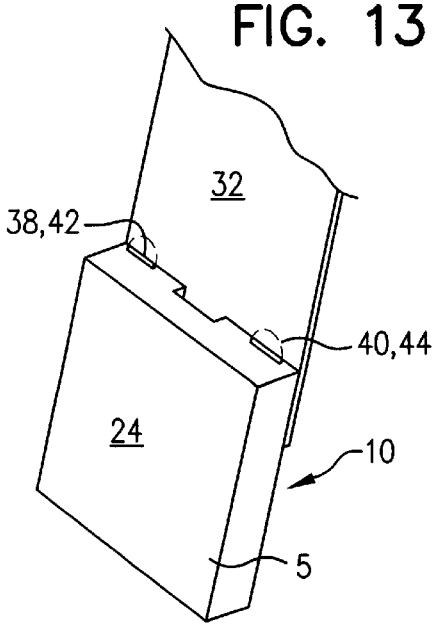
FIG. 13 is a view like FIG. 12 but shows the invention clipped to a flat position.

FIGS. 12 and 13 illustrate a means for keeping the bookmark 32 and the base 5 flat when support 10 is not in use. Tabs 38 and 40 can be respectively received into slots 42 and 44 located in the bookmark 32, thereby flattening the shape of support 10. It is to be appreciated that there are numerous other ways to clip the two pieces flat against each other. For example, instead of using tabs, VELCRO® or small magnets can clip the pieces together.

Books come in varying thicknesses. The base 5 must be manufactured such that it can fit snugly into books of different sizes. The upper surface area 20 of base 5 must be wide enough to provide subjacent support under all of the book pages. If an undersized base 5 is fitted into too large of a book, then there will be inadequate binding support. Likewise, there will be inadequate support if an oversized base 5 is fitted into a small book. One solution is to manufacture base 5 in a multitude of varying sizes.

Another solution would be to manufacture base 5 with perforated sections that can be torn off so as to reduce the overall surface area 20 to match the thickness of a book. However, once a section is torn off, it cannot be reattached if the support 10 is to be reused on another, different-sized book. Accordingly, there is a need to manufacture a reusable, "one-size-fits-all" support 10 with an adjustable base 5.

Figure 14:
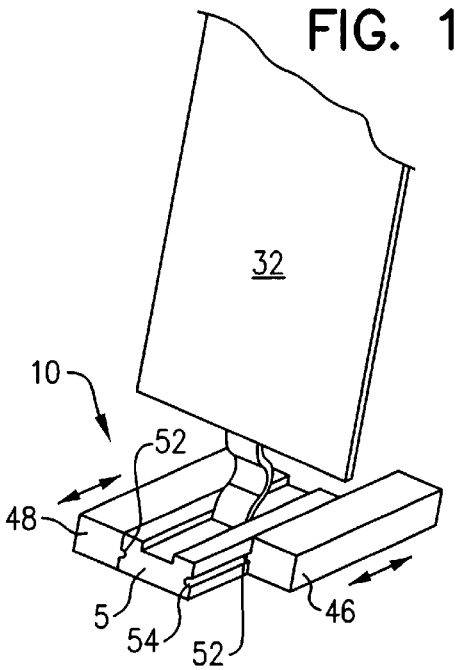
FIG. 14 shows a third embodiment of the invention.

FIG. 14 illustrates one solution and a third embodiment of the invention. Slidable attachments 46 and 48 are fitted to the edges of base 5. The attachments 46 and 48 can slide in the direction shown by the arrows, providing a base 5 with a variable width. The attachments 46 and 48 are movable via flanges 52 that mate with the channels 54 on base 5. The appropriate form/shape of the flange and channel to use would be familiar to those skilled in the art. What is important is that the attachments 46 and 48 do not separate from the base 5 and that there is sufficient friction between the flange 52 and the channel 54 to prevent the attachments 46 and 48 from slipping from a desired position.

Figure 15:
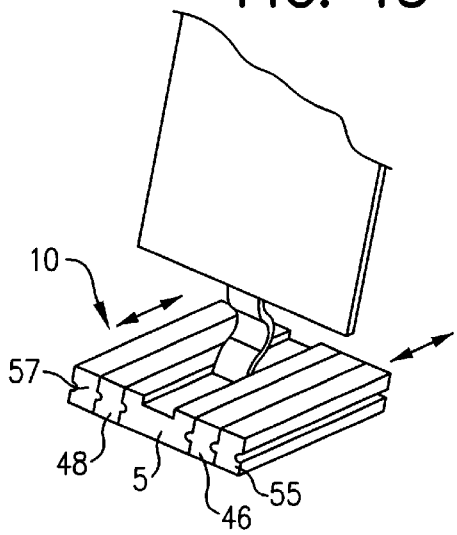
FIG. 15 shows a modification of the third embodiment shown in FIG. 14.

FIG. 15 illustrates that additional and multiple slidable attachments 55 and 57 can be connected to the first set of attachments 46 and 48, thereby providing a varying length, in addition to a varying width, for the base 5.

Figure 16:
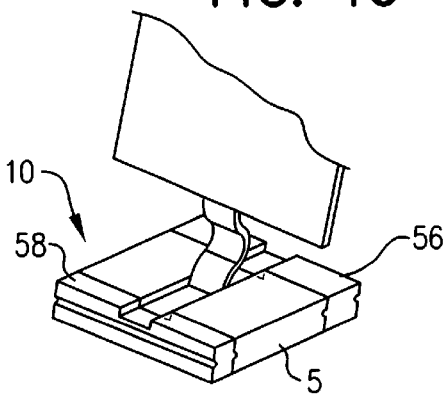
FIG. 16 shows another modification of the third embodiment shown in FIGS. 14 and 15.

FIG. 16 shows an alternate method of connecting attachments 56 and 58. Rather than being slidable to match the width of the book, the attachments 56 and 58 are connected as needed to base 5 until the appropriate width is attained. Obviously, with this method, the width is adjustable incrementally, as opposed to variably (shown in FIGS. 14–15).

In FIGS. 14–16, the slidable attachments are shown as being connected to the second, bookmark embodiment of the invention. It is to be appreciated that these attachments will function equivalently if they are attached solely to the first embodiment. Although not shown in the drawings, the adhesive strip 28 can be easily attached to base 5 so as not to interfere with the motion of the sliding attachments.

Figure 17:
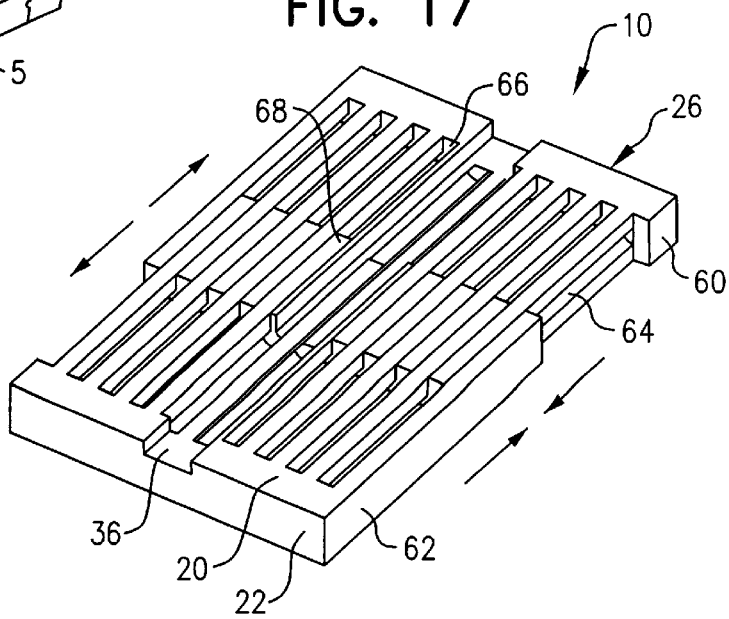
FIG. 17 shows a fourth embodiment of the invention.
Figure 18:
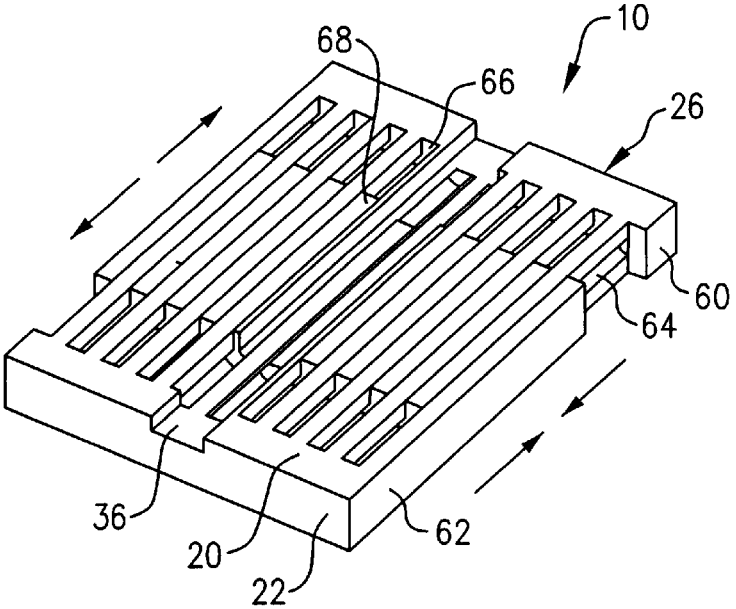
FIG. 18 is a view like FIG. 17 but shows a narrowed shaped of the fourth embodiment.

FIGS. 17 and 18 illustrate a fourth adjustable embodiment of the support 10. The base of support 10 is comprised of two mating, slidable sections 60 and 62. Sections 60 and 62 are slidable to vary the width of the base of support 10. FIG. 18 shows a narrowed base. Sections 60 and 62 have a plurality of mating channels 66 and fingers 68. Fingers 68 also have a plurality of internal channels 64 that mate with opposing flanges (not shown) located on the corresponding fingers, for further securing and providing a track for the sections 60 and 62 to slide. Again, the appropriate shape of the internal channels 64 and the corresponding flanges would be familiar to those skilled in the art. The important requirement is that the sections 60 and 62 are movable, much like a slide rule, and that the fingers 68 and channels 66 have sufficient friction between them to keep sections 60 and 62 fixed at a desired position.

The embodiment shown in FIGS. 17 and 18 are both functional with the adhesive strip and the bookmark embodiment discussed above. Although not shown, the bookmark clip 34 can be fitted into grove 36. Likewise, the adhesive strip 28 can be attached along surface 26 of section 60.

Figure 19:
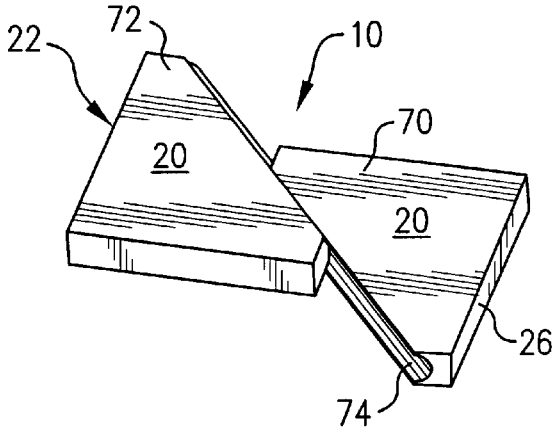
FIG. 19 shows a fifth embodiment of the invention.

FIG. 19 shows the fifth embodiment for an adjustable support 10. The base consists of two triangular parts 70 and 72 that slide at an angle relative to each other to match the width of the book. The width of the base when parts 70 and 72 slide along a mating slot 74. As with previous embodiments discussed above, the appropriate design for the mating slot 74 would be familiar to those skilled in the art. Slot 74 must have some friction in order for parts 70 and 72 to maintain their position, and also slot 74 must be capable of firmly holding parts 70 and 72 together. This embodiment is attachable to a book by adhesive strip 28 (not shown) affixed to surface 26 or by bookmark clip 34 (not shown) attached to either parts 70 or 72.

Figure 20:
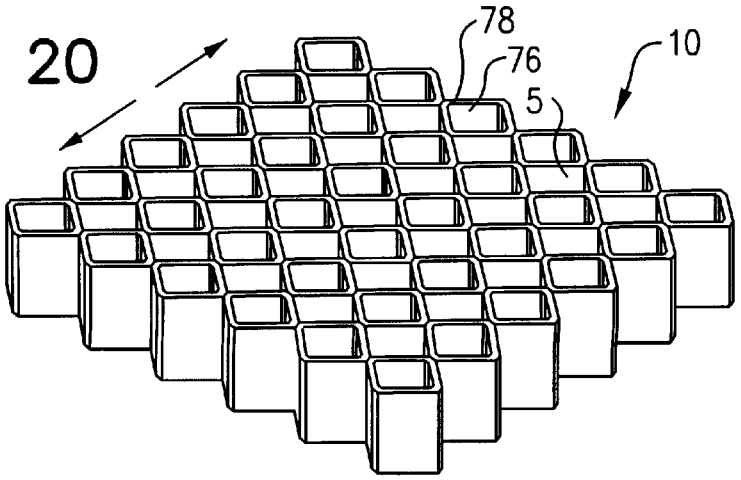
FIG. 20 shows a sixth embodiment of the invention.
Figure 21:
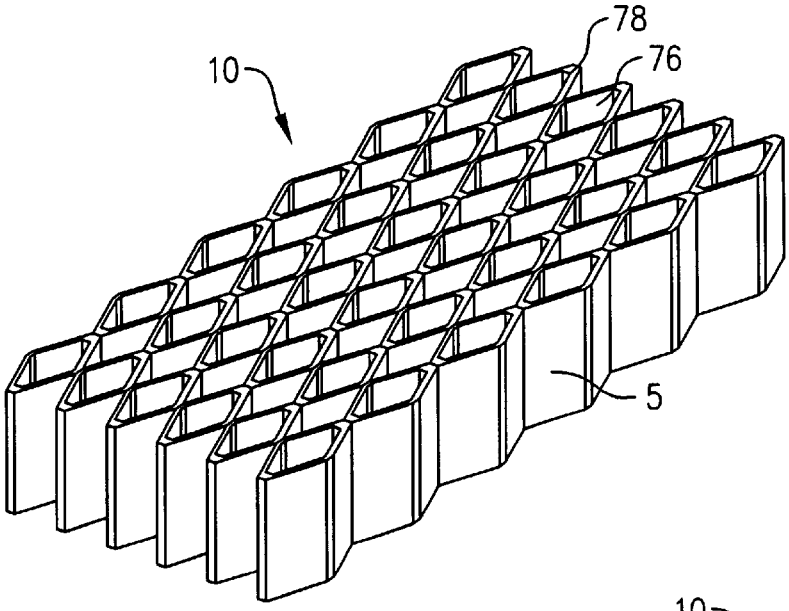
FIG. 21 is a view like FIG. 20 but shows a narrowed shape of the sixth embodiment.

FIGS. 20 and 21 show a sixth embodiment for an adjustable base of support 10. The base is made from a single piece of compliant material, such as polyethylene or polypropylene. This compliant material demonstrates visco-elastic properties that allow it to be shaped and reshaped in the same manner. A "collapsing-cell" design is shown in FIGS. 20 and 21. There is a plurality of openings 76, surrounded by cells walls 78, thereby forming a "honeycomb" architecture. This design allows the base 5 to be compressed, as shown in FIG. 21, to a width that is less than that of the book. Once released, the base 5 slowly expands to the width of the space between the hardback covers of a book. Although a honeycomb design is illustrated in FIGS. 20 and 21, it is to be appreciated that other visco-elastic foam-type materials can be used and will function equivalently. As with other embodiments described above, the bookmark clip 34 or adhesive strip 28 can be attached to the "honeycomb" base 5 to hold the support in place.

Figure 22:
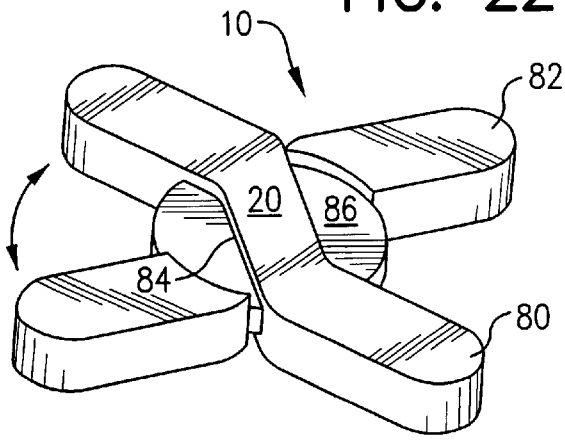
FIG. 22 shows a seventh embodiment of the invention.
Figure 23:
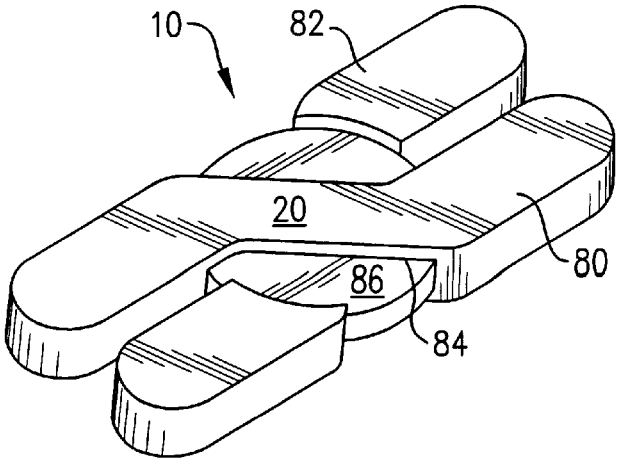
FIG. 23 is a view like FIG. 22 but shows a narrowed shape of the seventh embodiment.

A seventh embodiment is shown in FIGS. 22 and 23. The base of support 10 has been modified to use a "scissor" mechanism to achieve the correct width for a given book. Section 80 has an opening 84 in its center for receiving circular portion 86 of section 82. This arrangement allows sections 80 and 82 to rotate approximately 60 degrees relative to each other, in the same plane and about a single pivot point. The width of support 10 is varied simply by changing the degree of rotation. (See FIG. 23). In the embodiment shown, the central portion 86 of section 82 that mates with opening 84 of section 80 is shown as being circular in shape. Other variations of the scissor mechanism are also possible. As with all the embodiments described above, there must be sufficient friction at the "scissor" joint to prevent sections 80 and 82 from slipping out of position. The bookmark clip 34 can be attached to the central, upper surface 20 of section 80, and alternatively, the adhesive strip 28 can be affixed to any one of the "legs" of the scissors.

Except for the compliant material used in the sixth embodiment ("collapsing-cell" base shown in FIGS. 20 and 21), the base of support 10 is preferably made of two possible materials: paper or plastic. For non-adjustable supports (which can only be manufactured in multiple sizes), the material of choice is bleach board (which is essentially a paper or a wood pulp material) with a card stock covering, bound together by a water-based adhesive. This composition is similar to the construction of hardback book covers. This bleach board and card stock composition is simply cut to appropriate and varying sizes to fit different-sized books.

Paper, or more properly a wood pulp material, can be used to create the bookmark and the base. The processes to produce the bookmark 22 require the formation of wood pulp into thin sheets from which the desired shapes can be cut. This sheet material can alternatively be purchased in bulk form. Next, coloration and printing can be added to the bookmark 32. A final coating will not be applied until after the entire support 10 is finished so that no seams are left open to moisture in the final product. The bases are constructed from the same wood pulp as the bookmark but the process is considerably different. The base 5 is pressed to a shape with a density lower than that of the bookmark 32. The lower density material provides more "cushion" (lower modulus) than the more densely packed material of the bookmark 32. This material can also be purchased in bulk form, but then the shape of the base 5 will need to be cut and milled to the proper dimensions from the bulk material.

The clip 34 is made from a highly ductile metal or plastic film, and it is assembled to the base during the forming process of the base 5. This is accomplished by creating a small "S" shape on the end of clip 34 that is formed into base 5. This "S" shape provides the mechanical interlocking between the base 5 and clip 34. No adhesives are required to maintain this assembly. Adhesives may be required if the base 5 is manufactured from purchased stock materials. The opposite end of the clip 34 can be affixed to the end of the bookmark by an adhesive. Finally, the entire support 10 is coated with a clear laminate to protect the paper material and to provide a smooth surface.

For the more complicated shapes of the base of support 10, a variety of plastics including thermoplastic and thermosetting materials, can be used. Thermoplastics can be injection-molded, compression-molded, or extruded to form the components of the final product. Injection molding the entire support 10 in one process is possible for the first two embodiments of the invention. Later embodiments will require further assembly after the parts are made. The processes below describe the manufacture of the second embodiment of the invention but are applicable to all the other embodiments of the invention.

The clip 34 connecting the bookmark 32 to the base 5 can be positioned inside a mold and the plastic injected around it. This would provide a one-step manufacturing process to create all of the physical features of the support 10. Any surface coloration can be added at the next step. Thermosetting materials lend themselves to casting processing or reaction injection molding utilizing the same one-step process.

Thermoplastic materials used in forming the support 10 can be polyethylene or polypropylene materials with the appropriate fillers for coloration and modification of the material's modulus and visco-elastic properties. Polyethylene is advantageous in that is provides high strength, flexibility, good surface finish, and dimensional accuracy. Thermosetting materials can be polyurethanes with the appropriate fillers for coloration and modification of the material's modulus and visco-elastic properties.

Both casting and injection molding allow for the support's physical features to be completed in one step. Extrusion and compression molding will require that the bookmark 32 and the base 5 be made separately. Assembly of the parts with the clip 34 can be done using an adhesive-bonding process. This adhesive-bonding process depends on the materials used. The thermoplastics can be bonded to each other and to metals using heat and pressure or thermosetting adhesives. Thermosetting materials will require the use of thermosetting adhesives for assembly.

Any combination of the above listed materials and processes can be used in the construction of the support 10. For example, if it is found that a bookmark 32 made from wood pulp is more desirable than plastic, the base 5 and clip 34 can be injection molded together and the bookmark 32 can be adhesively fastened at a later step. Further detailed descriptions of these materials and processes will not be provided because they are well known in the art.

While the invention has been described here in terms of what the inventors consider as their preferred embodiment, it is to be appreciated that many variations could be made to the invention without departing from its spirit and scope. Accordingly, this specification is not meant to be limiting. Instead, the invention is to be limited by the claims that follow, the interpretation of which is to be done under established doctrines of patent claim interpretation.

What is claimed is:

1. A supporting device for providing subjacent support to pages of a book having two hardback covers when said book is positioned vertically on the surface of a bookshelf, comprising:

a substantially flat base having an upper surface, a lower surface and a certain width;

said lower surface being positionable to rest over and against said surface of said bookshelf;

said upper surface being positionable to rest under and against said pages of said book, whereby said base is positioned between said hardback covers and between said pages of said book and said bookshelf surface; and at least one elongated bookmark member connected to said upper surface of said base, said bookmark member being positionable between said pages of said book and capable of being captured thereby when said book is in a closed position.

2. The device of claim 1, wherein said width is adjustable.

* * * * *